US005496343A

United States Patent [19]

Reil

[11] Patent Number: 5,496,343

[45] Date of Patent: Mar. 5, 1996

[54] HAND HELD DISPOSABLE EAR PIERCER

[76] Inventor: Vladimir Reil, 30524 Ganado Dr., Rancho Palos Verdes, Calif. 90274

[21] Appl. No.: 292,249

[22] Filed: Aug. 18, 1994

[51] Int. Cl.[6] ..... A61B 17/34

[52] U.S. Cl. ..... 606/188

[58] Field of Search ..... 606/188, 185, 606/117; 227/134

[56] References Cited

U.S. PATENT DOCUMENTS

| | | | |
|---|---|---|---|
| 3,943,935 | 3/1976 | Cameron | 128/330 |
| 4,020,848 | 5/1977 | DiLocco | 606/188 |
| 4,030,507 | 6/1977 | Mann | 128/330 |
| 4,079,740 | 3/1978 | Phalon | 128/330 |
| 4,164,224 | 8/1979 | Hastings | 128/330 |
| 4,191,190 | 3/1980 | Hastings | 128/330 |
| 4,286,600 | 9/1981 | Judickas | 128/330 |
| 4,527,563 | 7/1985 | Reil | 128/329 |
| 4,931,060 | 6/1990 | Aué | 606/188 |
| 5,004,470 | 4/1991 | Mann | 606/188 |
| 5,004,471 | 4/1991 | Mann | 606/188 |
| 5,007,918 | 4/1991 | Mann | 606/188 |
| 5,211,653 | 5/1993 | Nakajima | 606/188 |
| 5,263,960 | 11/1993 | Mann | 606/188 |

*Primary Examiner*—Stephen C. Pellegrino
*Assistant Examiner*—Scott B. Markow
*Attorney, Agent, or Firm*—Cislo & Thomas

[57] ABSTRACT

An ear piercing instrument that uses the gripping force of a hand to drive the earring post through the ear and into an earring nut. The earring and its nut are held in opposing jaws while the earlobe is placed between the jaws. When the ear is ready for piercing, the hand gripping the ear piercer is first tightened to bring the earring into closer proximity to the nut. A frangible tab holds the ear piercing process in abeyance until the hand squeezes sufficiently hard to break the frangible tab. Upon breaking the frangible tab, the earring and nut jaws are rapidly accelerated towards each other by the squeezing hand. The intermediate earlobe (or other body part) is pierced. With the insertion of the nut jaw into the earring jaw, a flexible tang catches the back side of the earring cartridge to expel it when the nut jaw is withdrawn from the earring jaw. A top gap is present in the earring jaw above and adjacent to the earring cartridge, allowing the use of ornamented earrings having hoop or other type of extensions.

27 Claims, 3 Drawing Sheets

HAND HELD DISPOSABLE EAR PIERCER

BACKGROUND OF THE INVENTION

1. Field of the Invention

This invention relates to ear piercing devices, and more particularly to hand held ear piercing devices that may be used once and then discarded.

2. Description of the Related Art

Generally, in order to pierce a human ear, a sharp object is used to penetrate the ear lobe and then the wound is allowed to heal around an inner post so that the fenestration is maintained. Originally, ear piercing was a minor surgical operation that has since become one of an even more casual nature. Recently, hand held devices for piercing ears have been developed, put into use, and made available to the public. Many of these have several parts, operating in an elaborate manner and are therefore subject to failure or improper operation which frustrates the clean piercing of an ear with minimum time and trouble. Others are of a more simple design and lend themselves even to home use. Of course, when such home use is made of an ear piercing device, it is important that the ear piercing device is easy to use and creates the pierce in a reliable, accurate and sanitary fashion.

In the drawings, FIGS. 1 and 2 respectively show a perspective and side cross-section views of an ear piercer known in the art. This ear piercer was disclosed in Japanese patent application No. 4-214240 filed Nov. 8, 1992.

Several features of the Japanese ear piercer shown in FIGS. 1 and 2 bear mention. There are two major portions to the ear piercer: a housing having three channels, and a plunger unit having two arms that fit into two corresponding lower channels in the housing. The third and top channel serves to slidably hold an earring holding cartridge. The earring holding cartridge is held by the housing directly opposed to the backing or nut that serves to hold the earring in place upon the ear. The plunger unit has means by which the nut may be held oppositely opposed the cartridge. When the ear is to be pierced, the lobe is placed between the channeled housing and the plunger unit. Force is then applied as by a human hand to bring the two housing units together. Breakable tabs are present as shown by reference numbers $T_1$ and $T_2$ that serve to temporarily obstruct the bringing together of the housing and plunger units. As greater force is applied by the human hand, a build-up of pressure correspondingly develops until frangible tabs $T_1$ and $T_2$ can no longer withstand the force applied, abruptly break, releasing the plunger and housing units to rapidly come together. In so doing, the post held in the cartridge is rapidly propelled toward the earring nut. The tip of the post is very sharp, and the pressure applied at its end is so great that it pierces the ear lobe flesh placed between it and the earring nut. The abrupt breaking of the two frangible tabs allow a sufficient force to develop to drive the post through the ear lobe and into the earring nut.

When the post is through the ear and nut, the force of the hand gripping the ear piercer is relaxed and a spring pushes apart the two units so that the ear piercer may release the newly-pierced ear lobe. The earring cartridge C is designed to disassemble upon extraction from the channeled housing. The ear is then free to be washed and sterilized to prevent infection, the earring and nut remaining upon the ear. After piercing, certain sanitary procedures are performed daily to ensure that infection of the healing wound does not occur.

In light of the present invention, discussed and disclosed in detail below, the related hand held ear piercer of FIGS. 1 and 2 has several disadvantages and inefficiencies that are remedied by the present invention. As can be seen from FIGS. 1 and 2, the related art ear piercer has three channels, requiring the use of additional materials in order to construct the device. Such additional materials increase the cost while not necessarily increasing the effectiveness of the device.

Also, as indicated by reference numbers $L_1$ and $L_2$, a latch is present that keeps the two units from separating when urged apart by the spring. This latch requires even more additional material in order to construct the separate extension on the plunger unit holding the hook. At the top of the plunger means, the apparatus used for holding the earring nut in place is capable of holding the nut in place only when held upright. If the Japanese ear piercer is for any reason held upside down, the earring nut tends to fall from the plunger unit, defeating secure piercing of the ear.

The earring cartridge shown in the Japanese ear piercer only holds simple stud-type earrings. No extensions from the earring such as hoops can be accommodated by the Japanese ear piercer. Furthermore, sometimes the earring cartridge remains within the channeled housing when it should not do so. This usually occurs when the attempt to pierce the ear has for some reason failed. When the earring cartridge is not extracted from the channeled housing, it then becomes a difficult task to disengage the entire ear piercer from the ear.

The Japanese ear piercer does not provide much room for insertion of the ear between the housing and the plunger unit. This limits choices as to the location of the pierce. The use of dual frangible tabs is not required, but does add cost and expense. The spring inside Japanese ear piercer is not necessarily held in place by any restraining means other than the channel and has the potential to become misaligned within the channel. The use of dual plungers into the dual channels is an inefficiency that could just as easily and perhaps better be realized through the use of a single plunger and a single channel.

In order to realize a better hand held ear piercer that is reliable, accurate, sanitary and disposable, the Japanese ear piercer has many shortcomings that are better addressed by the present invention.

SUMMARY OF THE INVENTION

The present invention is a hand held disposable ear piercer of simple yet refined construction. By the use of many advantageous design features, the hand held ear piercer of the present invention is smaller in size, yet allows greater maneuverability and positioning to be made for the pierce.

A pair of jaws is used that hold corresponding parts of a pierced ear earring. The earring jaw holds the earring with its piercing post, while the nut jaw holds the earring nut with its aperture and spring retaining means that hold the earring securely upon the ear after the ear has been pierced.

The earring jaw requires only two channels. The lower channel provides alignment means for the ear piercer so that the earring and its nut can be properly aligned. The upper channel holds a disassembling earring cartridge. A top slot in the earring jaw above the earring cartridge provides room through which a hoop type pierced ear earring may project, yet be retained by the earring cartridge and used in the present invention. Most previous handheld ear piercers could only carry simple stud-type pierced earrings.

At the bottom of the earring jaw, a slot is present that is used to retain the nut jaw. The nut jaw has a hook that fits into the slot and is retained by a forward end of the slot so that the nut jaw does not disengage from the earring jaw.

The nut jaw has three basic sections: the earring nut holding section, the earring jaw engaging section, and an extension portion separating the prior two sections by an appropriate and preferred distance for best ear piercing. The earring jaw engaging section is elongated so that the nut jaw may be easily and consistently aligned with the earring jaw. The elongated nature of the earring jaw engaging portion deters and prevents any misalignment between the earring nut and the earring. Any wiggling or misalignment that might ordinarily take place between the earring and nut jaws is greatly reduced by the elongated nature of the earring jaw engaging portion of the nut jaw. As the elongated portion is confined within the lower channel of the earring jaw, the degree of articulation is greatly reduced between the earring jaw and the nut jaw.

The elongated portion has a central bore to defined by two extensions that protrude forwardly. Between these two extensions, the bore is defined within which a spring may be held in place so that the earring jaw is constantly urged away from the nut jaw.

An ejection tang connected to the top extension serves to eject the earring cartridge once the frangible tab has been broken and the nut jaw slides into the earring jaw or (similarly) the tang slides past the earring cartridge. When the nut jaw is withdrawn from the earring housing, the earring cartridge is ejected. A tongue with a downwardly extending hook fits into the slot on the bottom of the earring housing. The tongue with its hook serves to prevent withdrawal of the entire nut jaw from the earring jaw, and keeps the two jaw portions of the ear piercer together.

The extending connection between the earring jaw engaging portion and the nut holding portion is constructed so that the nut jaw can travel the full distance of the lower channel of the earring jaw and so that the fingers of the person holding the ear piercer may securely engage the nut jaw.

The nut holding portion has a block with a crossed set of grooves that serve to hold the earring nut in place. In order to further ensure that the earring nut is held in place, a finger extends upwardly from the floor of a groove to engage a lower rear portion of the earring nut. This finger provides frictional means by which the earring nut may be held in place without falling out, but yet can be easily removed when it is time to withdraw the earring nut from the nut jaw.

It is an object of the present invention to provide a hand held disposable ear piercer.

It is another object of the present invention to provide an ear piercer that is well-constructed and that provides means by which the public may easily and quickly pierce their ears.

It is another object of the present invention to provide a disposable ear piercer that ejects its earring cartridge.

It is another object of the present invention to prevent the earring nut from falling out of its holder.

It is yet another object of the present invention to provide a hand held disposable ear piercer that is easy to manufacture and that efficiently uses materials.

These and other objects and advantages of the present invention will be apparent from a review of the following specification and accompanying drawings.

DESCRIPTION OF THE PREFERRED EMBODIMENT(S)

Figure 1:
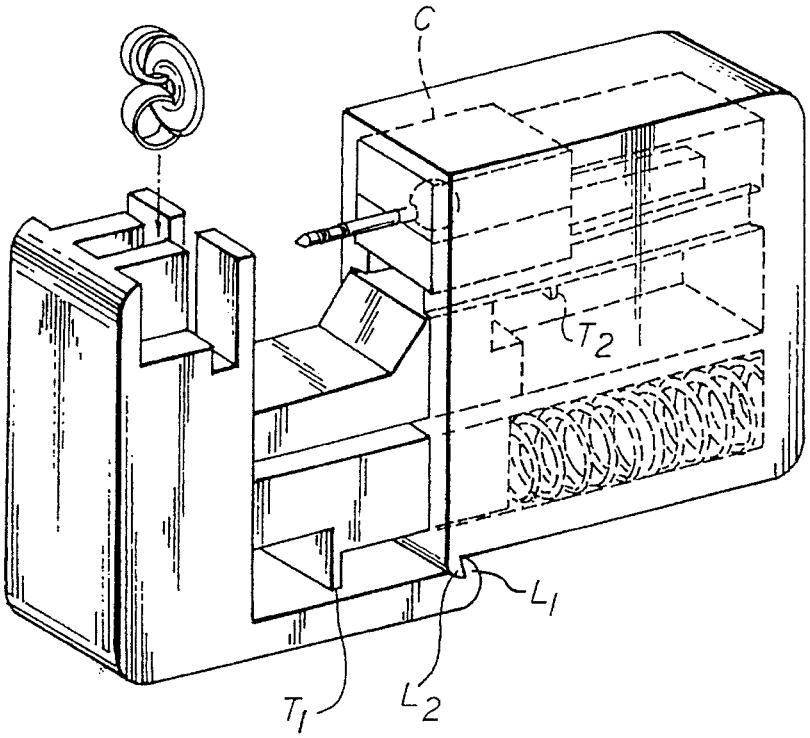
FIG. 1 PRIOR ART
FIG. 1 shows in side perspective view a hand held ear piercer known previously in the art. Areas internal to the ear piercer are shown in phantom.

The ear piercer 10 of the present invention is a disposable handheld unit that can be easily used in the privacy of one's own home with a minimum of difficulty. Primarily, there are three parts of the present invention that operate to pierce the ear: the earring jaw 12, the nut jaw 14, and the earring cartridge When an earlobe (or other body part) is placed between the earring jaw 12 and the nut jaw 14, compression of the ear piercer 10 serves to drive the earring post P through the earlobe E and into the nut N held by the nut jaw 14. When released, the ear piercer 10 ejects the earring cartridge 16 which immediately disassembles to release the earring R. The nut N is then extracted from the nut jaw 14, completing the ear piercing process.

The earring jaw 12 is a specialized housing that allows proper operation for the ear piercer 10. The earring jaw 12 is generally rectangular in nature, approximating a rectangular prism. The earring jaw 12 has two interior channels running its length. The first top channel 18 holds the earring cartridge in a forward portion. The second lower channel 20 provides means by which the earring and nut jaws 12 and 14 may constructively engage one another.

Two runners 22*a*, b travel the length of the rectangular earring jaw 12 to define and separate the upper channel 18 from the lower channel 20. The two runners 22*a, b* extend interiorly into the earring jaw 12 and run its entire length. The two runners 22*a, b* define uniformly rectangular upper and lower channels 18, 20, although the upper channel may be smaller or larger than the lower channel.

In order for the earring cartridge 16 to forwardly dispose the earring R, the upper earring channel 18 keeps and holds the earring cartridge 16 in the forward portion of the upper channel 18. In order to do so, a series of stops are used that decrease the interior cross-section of the upper channel 18, preventing the passage of the earring cartridge 16 into the rear of the upper channel 18. The positioning of these stops determines the depth to which the earring cartridge 16 will travel into the upper channel In a preferred embodiment of the present invention, the ear piercer 10 of the present invention is as small and compact as possible while yielding optimum ear piercing operation. Under such circumstances, the stops in the upper channel are placed so that the earring cartridge 16 travels approximately halfway into the upper channel 18, allowing the earring cartridge 16 to fit entirely within the upper channel 18.

Other stop means operating in a manner similar to the ones presented herein may be used to prevent passage of the earring cartridge 16 through the upper channel 18. In the present invention, four stops are used at each of the corners of the upper channel 18. A first stop 24*a* is present in the lower right corner of the upper channel 18 nestled atop the right runner 22*a* and adjacent the right side 26 of the earring jaw 12. The second stop 24*b* is nestled atop the second runner 22*b* and adjacent to the left side 28. The third stop 24*c* is nestled in the upper right hand corner of the upper channel present between the right side 26 and the top side 30 of the earring jaw. The fourth stop 24*d* is nestled in the upper left hand corner of the upper channel 18 present between the left side 28 and the top side 30.

While the upper channel 18 holds the earring cartridge 16 in place, the earring cartridge 16 may slide into and out of the forward portion of the upper channel 18. There are two gaps present in the earring jaw 12 on opposite sides of the earring cartridge 16. The bottom gap is defined by the two runners 22*a*, b, but the remaining gap above the earring cartridge 16 is defined by the right and left sides 26, 28 of the earring jaw Two lateral projections 32*a, b* are on either side of the top gap 34. The two lateral projections 32*a, b* hold the earring cartridge 16 at its top in the same way the lower portion of the earring cartridge 16 is held between the runners 22 and the left and right sides 26, 28 of the earring jaw Between the two projections is the top gap 34. The lower gap between the two runners provides space through which the frangible tab 86 of the earring cartridge may move when the earring cartridge 16 is inserted into the earring jaw. The top gap 34 above the earring cartridge 16 provides space through which a hoop ornament such as that shown in phantom in FIG. 4 or other ornamentation attached to the earring may be accommodated by the ear piercer 10. Other extending ornaments attached to the earring may also be used and may also project through the top cartridge gap so long as no interference is made with the operation of the ear piercer 10.

The lower channel 20 is defined at its top by the runners 22*a, b* and on its other sides by the sides 26, 28 and bottom 36 of the earring jaw. At the interior wall of the rear side 38 of the earring jaw 12 is a spring post 40 that extends into the interior of the lower channel 20 parallel to the bottom side 36 of the earring jaw 12. The spring post 40 provides stability for biasing means such as a spring 42 that can surround the spring post 40 and be maintained in position by it. The spring post 40 provides means by which the spring 42 may be engaged. Other biasing means may also be engaged by the spring post 42 or the like.

On the exterior rear side 38 of the earring jaw, a series of ribs 44 are present that are oppositely opposed to the spring post 40. The earring jaw ribs 44 serve to provide traction and additional gripping friction for the ear piercer 10 when put into use.

Centrally running along the bottom side 36 of the earring jaw 12 beginning at its rear 38 is a slot 46. The bottom slot 46 provides room for a hooked tongue 68 present at the forward end of the nut jaw 14. The forward edge 48 of the bottom slot 46 engages the hooked tongue 68 when the nut jaw 14 is retracted as far as possible from the earring jaw 12. When the hooked tongue 68 of the nut jaw 14 engages the forward edge 48 of the bottom slot 46, retraction of the nut jaw stops. Further retraction is only possible by disengaging the hooked tongue 68 from the forward edge 48 of the bottom slot 46. From the foregoing, it can be seen that the hooked tongue 68 in conjunction with the forward edge 48 of the bottom slot 46 form a means for retaining the nut jaw 14 in slidable engagement with the lower channel 20.

The earring jaw 12 is preferably made of plastic or other easily moldable material, preferably sufficiently strong to withstand the forces exerted upon it during the ear piercing process.

The nut jaw 14 is constructed to provide many operating features of the present invention. The nut jaw 14 has means by which it remains aligned with respect to the earring jaw 12 and the earring cartridge 16, as well as means by which the earring nut N can be held oppositely opposed to the earring post P. Further, the nut jaw 14 has the ejection means for ejecting the earring cartridge, and retention means that retain the nut jaw's coupling to the earring jaw 12.

Figure 4:
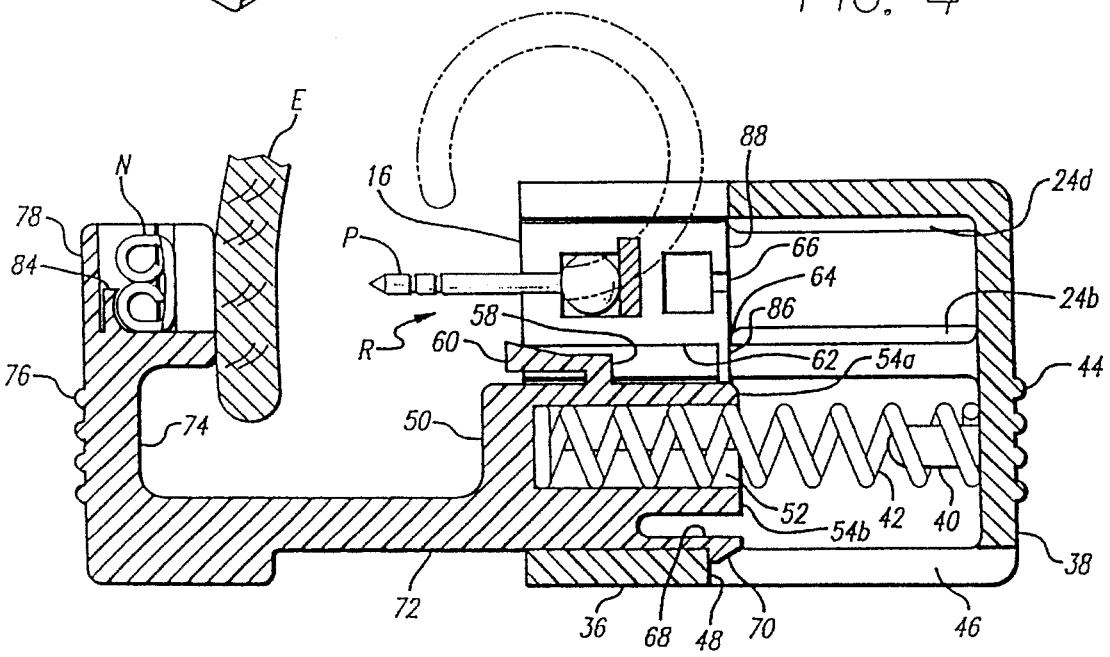
FIG. 4 shows a right side cross-sectional view of the handheld ear piercer of FIG. 3. Shown in phantom is a hoop ornament travelling up through the gap present adjacent the earring cartridge. An earlobe portion is shown adjacent to the nut holding portion of the invention.
Figure 5:
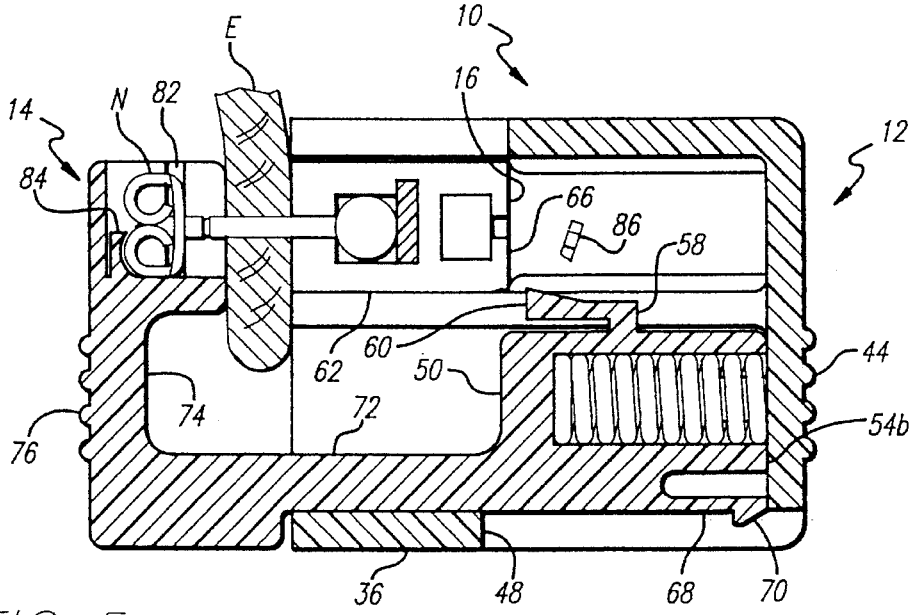
FIG. 5 shows a right side cross-sectional view of the present invention immediately after the earlobe has been pierced. The frangible tab of the earring cartridge has been broken by this process.
Figure 6:
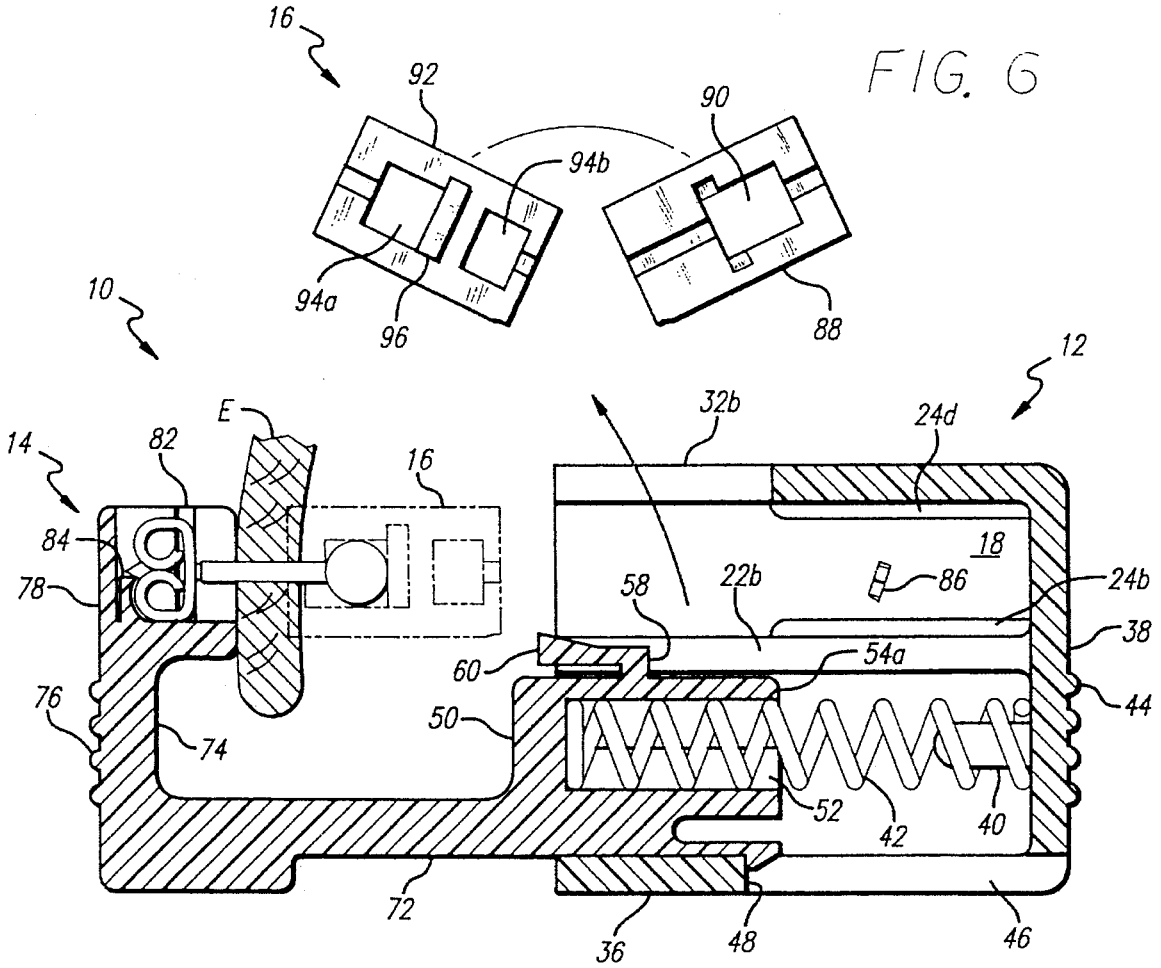
FIG. 6 shows a right side perspective view of the present invention after the nut jaw is then extended from the earring jaw. The portions of the earring cartridge surrounding the earring have been ejected and disassemble to release the earring, freeing it from the ear piercer. The nut remains to be withdrawn from the nut jaw.

As seen in FIGS. 4–6, the nut jaw 14 engages the second and lower channel 20 of the earring jaw 12 through an elongated portion 50 that provides stability and prevents misalignment between the nut jaw 14 and the earring jaw 12. The elongated portion 50 provides a means by which the nut jaw 14 may slidably engage the earring jaw 12 and has a bore 52 within its center that is defined by two extensions 54*a*, b. The top extension 54*a* covers the top and a partial side of the bore 52, leaving a gap 56*a* between the second extension 54*b* that covers the bottom of the bore 52 and part of the opposite side of the bore. The bottom extension 54*b* leaves a gap 56*b* between itself of the top extension 54*a*. The bore 52 provides room for biasing means such as a spring 42 which is held between the two extensions 54*a, b*.

On top of the top extension 54*a* is an ejection means that serves to eject the earring cartridge 16 once the ear piercing procedure has been performed. Extending from the top of the top portion is a post 58 that holds in spaced apart relation a flexible tang 60 that flares upwardly towards the earring cartridge 16. The tang 60 is flexible so that it may engage the underside 62 of the earring cartridge 16 while beneath it. When the nut jaw 14 is sufficiently inserted into the earring jaw the flexible tang 60 moves past the far inner edge 64 of the earring cartridge 16. When so positioned, the bottom side 62 of the earring cartridge 16 no longer engages the top portion of the flexible tang 60 which is then allowed to flex upwardly above the bottom side 62 of the earring cartridge 16. As will be explained in more detail below regarding the operation of the ear piercer 10 of the present invention, the flexible tang 60 is then able to catch the back side 66 of the earring cartridge 16 to eject it from the earring jaw 12.

Beneath the elongated portion 50 of the nut jaw 14 is an extending tongue 68 that emanates from a neck present at the bottom of the nut jaw 14. The tongue 68 angles downwardly and has a hook 70 at its end which fits within and engages the bottom slot 46 of the earring jaw 12. The tongue 68 allows insertion of the nut jaw 14 into the earring jaw 12, but prevents the extraction of the nut jaw 14 from the earring jaw 12 as the hook 70 engages the forward end 48 of the bottom side slot 46. Initially, the hook 70 engages the forward end 48 of the bottom slot 46 as the spring 42 urges the nut jaw 14 away from the earring jaw 12.

The neck 72 of the nut jaw 14 extends forward from a nut holder to separate the elongated portion from the nut holder.

It can therefore be seen that neck 72 provides means by which extension can be made between the nut holder 78 and the elongated portion 50. The neck 72 is slightly less wide than the interior of the lower channel 20 so that the neck portion 72 and the elongated portion 50 may freely slide within the lower channel 20.

Towards the nut holding end of the nut jaw 14, the neck widens out to a width approximately the same as the width of the earring jaw 12. This wider area serves as an abutment or stop for the travel of the nut jaw 14 into the earring jaw 12. Either the wider neck portion or the forward end of the elongated section may provide the contact that stops the travel of the nut jaw 14 into the earring jaw 12.

From the wide end of the neck portion 72, an upright portion 74 travels upward to parallel the open face of the earring jaw 12. On the back side of the nut jaw 14, and oppositely corresponding to the ribs 44 of the earring jaw 12, ribs 76 are also present upon the nut jaw 14 so that a finger may engage the ear piercer 10. The upright portion 74, like the wider neck portion, is approximately as wide as the earring jaw 12 and when provided with the nut jaw ribs 74, provides means by which the ear piercer 10 may be safely gripped to perform the ear piercing procedure and means by which the nut holder 78 may be supported in a spaced apart from the neck 72 so that earring R and earring nut N are properly positioned with respect to each other.

Atop the upright portion 74 is a block that acts as a nut holder 78. This nut holder 78 holds the earring nut N by means of a pair of perpendicular grooves cut into the block. One of these grooves 80 is parallel to the neck extension 72 of the nut jaw 14, while the other one 82 is perpendicular to the first 80.

Commonly, earring nuts have a flanged portion with a central aperture. In back of the aperture, two springs are coordinatingly formed so that the earring post passing through the aperture may be flexibly and adjustably engaged by the springs to hold the flange in place upon the earring post.

The first groove 80 both allows the earring post access to the flange aperture as well as accommodates the two curl springs in back of the flange. The crossing groove 82 in the nut holder 78 holds the flange perpendicular to the earring post.

In construction, the nut holder 78 is positioned so that it is oppositely opposed the earring cartridge 16 and the earring R with its post P for the duration of the ear piercing procedure. It is the elongated portion 50 of the nut jaw 14 that prevents any articulation of the nut jaw 14 with respect to the earring jaw 12, thus holding the nut N directly in front of the earring post P.

Previously, nut holders used in hand held ear piercers had the tendency to only hold the earring nut when the nut holder was in an upright position. If for some reason the ear piercer was turned upside down (such as when the top of the ear was to be pierced), the earring nut would fall from the holder. In order to overcome this significant disadvantage, a flexible finger 84 rises up from the rear portion of the floor of the first nut holding groove 80. This flexible finger 84 engages the lower curl spring of the earring nut N to hold it in place by a slight compressive friction. As there is a standard size for the curl springs of earring nuts, the finger 84 will frictionally engage the curl springs for most earring nuts. The finger 84 engages the earring nut N with slight pressure and friction so that the earring nut N may be easily freed from the nut holder 78 after the ear has been pierced and the earring post P has been inserted through the flange aperture and is between the two curl springs.

The earring cartridge 16 is used to hold and position the earring R so that the earring post P of the earring R is aligned directly across from the flange aperture of the earring nut held in the nut holder 78. For ease of construction and use, the earring cartridge 16 is a module that disassembles into two pieces. In one embodiment, one piece has a frangible and breakable tab 86 to the rear portion of the bottom half of the earring cartridge 16. Such a "top/bottom" construction to the earring cartridge 16 may allow at least the bottom half to detrimentally drop into the void between the two jaws 12, where the earlobe E is held. Preferably, the earring cartridge 16 is constructed with left and right sides, each having one-half of the frangible tab 86 at the rear of their lowermost portions. When this preferred earring cartridge disassembles, it does so in a side-to-side fashion that avoids the area between the two jaws 12, 14.

Figure 2:
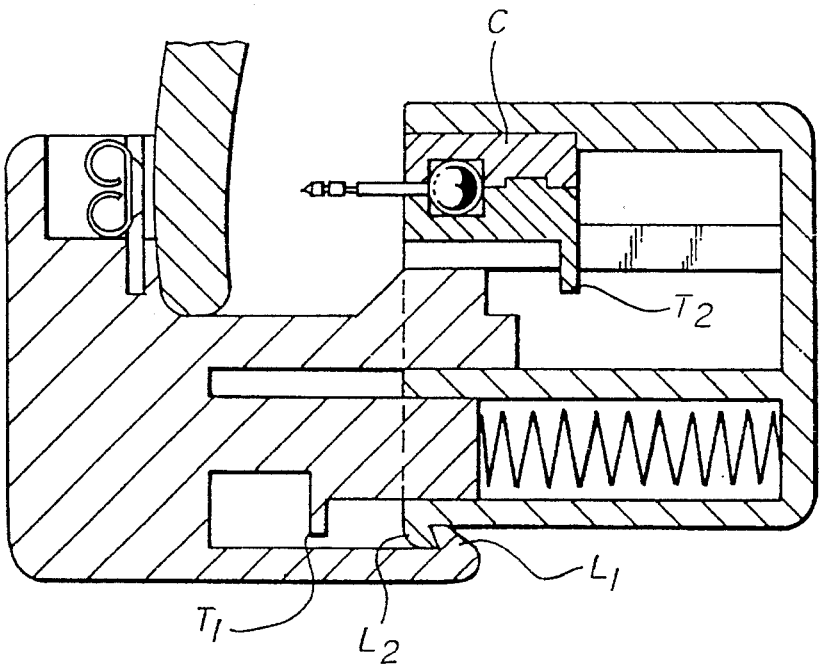
FIG. 2 PRIOR ART
FIG. 2 shows in side cross-sectional view of the related art ear piercer of FIG. 1 in which an ear lobe is shown between the earring and its nut.
Figure 3:
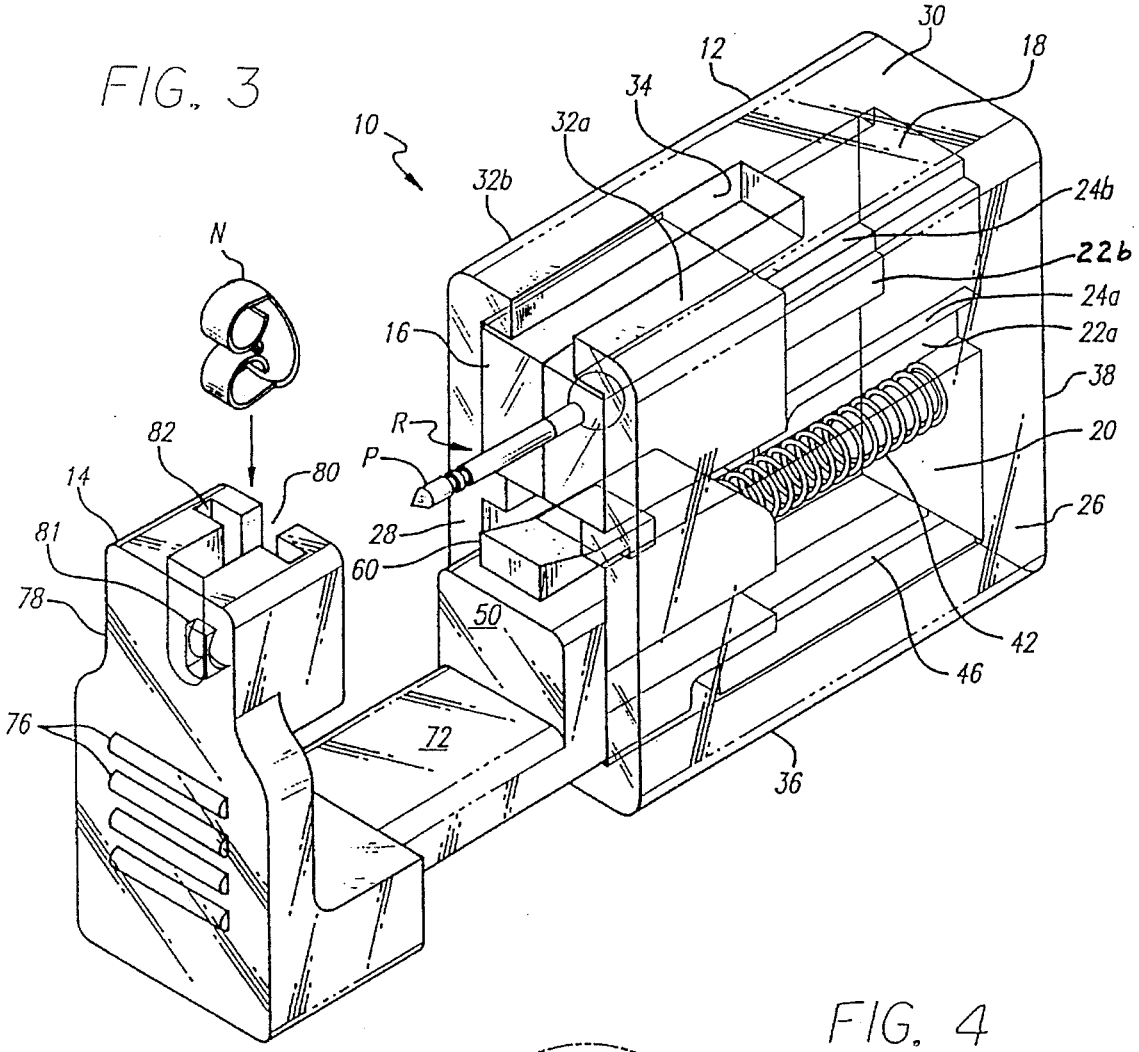
FIG. 3 shows a side perspective view of the hand held disposable ear piercer of the present invention.

In the "top/bottom" embodiment, a bottom half can server to provide cradle means by which an earring E can be engagedly carried. A top half that fits over the bottom half can serve as a cover means by the earring E can be held in place in the bottom half. Such a configuration is shown in a very basic form in FIGS. 1 and 2. Alternatively, and as preferably set forth above, the same "cradle/cover" configuration may be achieved in a side-to-side fashion as shown in FIGS. 3–6.

For either embodiment, the frangible tab 86 extends downwardly into the gap defined between the two runners 22*a, b* and prevents the complete insertion of the nut jaw 14 into the earring jaw 12 until the ear is ready to be pierced. The frangible tab 86 may be broken by the strong pressure applied by a hand to the ear piercer 10.

The right side portion 88 of the earring cartridge 16 has a well 90 within which the head of the earring R may be fit. A small indentation at the front of the earring cartridge 16 provides room for the earring post P. A corresponding groove in the left side half 92 of the earring cartridge 16 provides room for the earring post P to pass through and allows the earring R to be snugly fit between the two halves 88, 92 of the earring cartridge 16 as the left half 92 has a well corresponding to the well 90 of the right half 88.

The left half 92 of the earring cartridge 16 has two wells 94*a, b* of different sizes so that different sizes of earring heads may be accommodated within the earring cartridge 16. A boss 96 projects out and away from the interior of the left half 92 of the earring cartridge 16. This boss 96 is offset slightly to one side and is between the two wells 94*a, b* of the left cartridge half 92.

Corresponding depressions (not shown) continuous with the well 90 of the right half 88 of the earring cartridge 16 provide means by which the boss 96 of the left cartridge half 92 may engage the right half 88. One depression is on each side of the right well 90 with one offset more forward than the other. For earrings with larger heads, the larger left half well 94*a* is used. For smaller heads, the smaller well 94*b* is used by turning the left half 92 one hundred eighty degrees (180°). The offset nature of the boss 96 serves to provide securement for the two different sizes of earring heads. For example, for smaller earring heads, the boss will be offset forward and to the upper side of the earring cartridge 16, while for larger earring heads, the boss 96 will be offset back and to the lower side. The depressions in the right half 88 of the earring cartridge 16 correspond to these two positions of the boss 96 and as they are continuous with the well 90 of the bottom half 88, appear as small indentations upwardly forward and downwardly back in the right well 90.

To the rear of the right cartridge 88 is a small protuberance that corresponds to a groove in the left half 92 of the earring cartridge 16. The small protuberance from the right half 88 of the earring cartridge 16 serves to engage the small grooves cut into the front and rear of the left half 92 of the earring cartridge 16, further securing the top half 92 of the earring cartridge 16 with respect to the bottom half 88.

As indicated above, the frangible tab 86 of the earring cartridge 16 projects downwardly from both cartridge halves 88, 92 into the gap between the two runners 22*a, b* of the earring jaw 12. The frangible tab 86 is engaged by the post 58, extending upwardly from the elongated portion 50 of the nut jaw 14, to support the flexible tang 60. The frangible tab 86 may be broken by the post 58 with a sufficiently strong force available from the compression of a human hand.

In operation, the hand held disposable ear piercer 10 of the present invention acts as follows. Originally, the spring 42 or other biasing means forces the nut jaw 14 away from the earring jaw 12 as far as the bottom slot 46 and hooked tongue 68 will allow. Ample room is provided between the nut jaw 14 and the earring jaw 12 for the insertion of an earlobe or other body part to be pierced. Once the earlobe is placed between the nut jaw 14 and the earring jaw 12, and necessarily between the earring post P and the earring nut N, a person's hand engages the ear piercer 10 such as by placing thumb and forefinger oppositely opposed on the ribs 44, 76 of the earring 12 and nut 14 jaws. The ear piercer 10 is then compressed to bring the back side of the tang post 58 in engagement with the frangible tab 86.

The frangible tab 86 will not break until sufficient force is applied to the ear piercer 10 by the hand. As pressure builds up, the frangible tab 86 holds in place until failure occurs and the frangible tab 86 breaks free of the earring cartridge 16 as shown in FIG. 5.

With the breaking of the frangible tab 86, the nut jaw 14 is now free to move towards the earring jaw 12 and does so in rapid fashion. The breaking of the frangible tab 86 happens so quickly that the force applied by the hand is irreversibly transmitted to the ear piercer 10 and drives the earring post P through the ear E and into the flanged aperture and through the curled springs of the earring nut N. In so doing, the elongated portion 50 of the nut jaw 14 compresses the spring 42 and travels to the rear of the earring jaw As the earring cartridge 16 is held in place by the stops 24, the flexible tang 60 (moving with the elongated nut jaw portion) moves along the bottom side 62 of the earring cartridge 16 until it finally reaches the back end 64 of the earring cartridge 16. Once past the back end 64 of the cartridge 16, the flexible tang 60 is free to rise up and above the plane of the earring cartridge bottom 62.

Should it have been the unhappy circumstance where, for some reason, the earring post P did not properly engage the earring nut N, there would not have been means in previous ear piercers by which the earring cartridge 16 could easily be extracted from the earring jaw 12. In the present invention, when the flexible tang 60 engages the rear or the back side 66 of the earring cartridge 16, the extraction of the nut jaw 14 from the earring jaw 12 (either by the spring 42 or by fingers of a hand), the flexible tang 60 pushes the rear side 66 of the earring cartridge 16 to eject the earring cartridge 16 from the top channel 18. As shown in FIG. 6, when the nut jaw 14 is extracted the distance allowed by the bottom slot 46, the earring cartridge 16 is ejected. As the two halves 88, 92 of the earring cartridge 16 were previously held together by the sides of the top channel 18, the earring cartridge 16 quickly disassembles upon ejection.

As mentioned above, the slot or gap 34 of the top channel 18 above the earring cartridge 16 provides room for ornamental extensions of the earring R. For such ornamental extensions, accommodating earring cartridges may be required.

While the present invention has been described with regards to particular embodiments, it is recognized that additional variations of the present invention may be devised without departing from the inventive concept.

What I claim is:

1. A handheld ear piercer, comprising:

an earring jaw, said earring jaw defining first and second channels, said earring jaw having lateral projection means defining an earring gap through which an earring portion may extend;

an earring cartridge, said earring cartridge slidably disposed in said first channel slidably engaging said lateral projection means; and a nut jaw, said nut jaw slidably engaging said second channel, said nut jaw having ejection means for ejecting said earring cartridge from said earring jaw after said nut jaw has slid into said earring jaw.

2. The handheld ear piercer of claim 1, wherein said earring jaw further comprises:

partition means for dividing the interior of said earring jaw into said first and second channels and for separating said earring cartridge from said nut jaw.

3. The handheld ear piercer of claim 2, wherein said partition means comprises:

a first runner, said first runner running along an interior length of said earring jaw approximately midway between a top side and a bottom side of said earring jaw adjacent a first side of the handheld ear piercer; and a second runner, said second runner running along the interior length of said earring jaw approximately midway between said top side and said bottom side of said earring jaw adjacent a second side of the handheld ear piercer opposite to said first side, said second runner oppositely opposed to said first runner: whereby said first and second runners defining a communicating gap between said first and second channels.

4. The handheld ear piercer of claim 3, wherein said earring jaw further comprises:

stop means for abutting and obstructing passage of said earring cartridge through said first channel, whereby said earring cartridge moves with said earring jaw towards said nut jaw.

5. The handheld ear piercer of claim 4, wherein said stop means comprises:

a first stop, said first stop adjacent to said first runner and said first side of said earring jaw, said first stop approximately midway between a rear and a front of said earring jaw;

a second stop, said second stop adjacent to said second runner and said second side of said earring jaw, said second stop approximately midway between said rear and said front of said earring jaw;

a third stop, said third stop adjacent to said first side of said earring jaw and said top side of said earring jaw, said third stop approximately midway between said rear and said front of said earring jaw; and a fourth stop, said fourth stop adjacent to said second side of said earring jaw and said top side of said earring jaw, said fourth stop approximately midway between said rear and said front of said earring jaw; whereby, an earring cartridge is obstructed from further travel into said first channel by said stops.

6. The handheld ear piercer of claim 5, wherein said stops run a length from said rear of said earring jaw to approximately midway between said rear and said front of said earring jaw.

7. The handheld ear piercer of claim 6, wherein a back end of said earring cartridge together with said rear of said earring jaw and said first and second sides serve to define a chamber behind said earring cartridge when said earring cartridge is obstructed from further travel into said first channel by said stop means, said chamber providing room for said ejection means to engage said earring cartridge.

8. The handheld ear piercer of claim 4, wherein said lateral projection means further comprises:

a first lateral projection extending inwardly from said first side of said earring jaw toward said second side; and a second lateral projection extending inwardly from said second side of said earring jaw toward said first side; whereby, said first and second lateral projections define said earring gap between themselves above said earring cartridge;

said earring gap extending into said earring jaw a distance just forward of said stop means.

9. The handheld ear piercer of claim 8, further comprising:

nut jaw retention means for retaining said nut jaw in slidable engagement with said earring jaw.

10. The handheld ear piercer of claim 9, wherein said nut jaw retention means comprises:

a bottom side of said earring jaw adjacent said second channel and defining an opening between an interior and an exterior of said earring jaw, said opening parallel to a length of said bottom side and extending from a rear portion of said earring jaw to a point just past a midpoint between said rear portion and a front portion of said earring jaw, said opening accommodating a hook coupled to said nut jaw introduced into said opening whereby said hook may travel along said opening and may be caught at a forward end thereof at said point just past said midpoint.

11. The handheld ear piercer of claim 9, wherein said earring jaw further comprises:

biasing engagement means for engaging a biasing means tending to urge said earring jaw away from said nut jaw.

12. The handheld ear piercer of claim 11, wherein said biasing engagement means comprises:

a spring post, said spring post coupled centrally to an interior rear wall of said second channel, said spring post extending into said second channel generally parallel to a bottom side approximately one-quarter the distance between a rear and a front of said earring jaw.

13. The handheld ear piercer of claim 11, wherein said earring jaw further comprises:

a plurality of ribs, said plurality of ribs present on an exterior of said earring jaw, generally opposite said second channel, said ribs providing means by which secure manual engagement may be made of the exterior of said earring jaw.

14. The handheld ear piercer of claim 1, wherein said nut jaw further comprises:

nut holding means for holding a nut corresponding to an earring post in alignment with said earring post;

extension means for extending said nut holding means away from said earring jaw; and slidable engagement means for slidably engaging said earring jaw, said slidable engagement means coupled to said extension means.

15. The handheld ear piercer of claim 14, wherein said nut holding means further comprises:

a nut holder; and support means for supporting said nut holder in a spaced apart relationship with said extension means.

16. The handheld ear piercer of claim 15, wherein said nut holder further comprises:

a block, said block coupled to said support means and defining first and second nut grooves within which an earring nut may fit, said first nut groove perpendicular to said second nut groove; and a finger, said finger rising up from a floor of said block in said first groove, said finger capable of engaging with slight friction a nut fitted in said first and second nut grooves whereby said nut may be securely held in place by said finger in said first and second grooves of said block yet easily disengaged from said block.

17. The handheld ear piercer of claim 16, wherein said support means for supporting said nut holder further comprises:

an upright portion supporting said block away from said extension means whereby a void is defined between said upright portion, said extension means, and said earring jaw to provide room for an earlobe, said upright portion having a width approximately the same as a width of said earring jaw to provide means by which said nut jaw may be manually engaged; and a plurality of ribs, said plurality of ribs present on an outward facing portion of said upright portion opposite said void, said ribs providing means by which secure manual engagement may be made of the exterior of said nut jaw.

18. The handheld ear piercer of claim 14 wherein said extension means further comprises:

a base portion coupled to said nut holding means, said base portion having a width approximately the same as a width of said earring jaw to provide means by which said nut holding means may be sturdily supported and to provide means by which said nut jaw may be engaged by said earring jaw thereby obstructing further slidable travel of said nut jaw into said earring jaw; and a neck portion, said neck portion coupled to said base portion and having a width approximately the same as a width of said second channel so that said neck portion may slide into said second channel.

19. The handheld ear piercer of claim 18 wherein said extension means further comprises:

a tongue portion, said tongue portion extending from said neck portion and terminating in a hook, said tongue portion descending at an angle from said neck portion whereby said catch may engage a terminal end of an opening present in a bottom side of said earring jaw.

20. The handheld ear piercer of claim 14, wherein said slidable engagement means further comprises:

an elongated portion slidably engaging the interior of said second channel.

21. The handheld ear piercer of claim 20, wherein said elongated portion defines a bore whereby said elongated portion may retain biasing means for urging said nut jaw away from said earring jaw.

22. The handheld ear piercer of claim 21, wherein said bore is defined by first and second nut jaw extensions, said first nut jaw extension extending above said bore and said second nut jaw extension, said first and second nut jaw extensions having oppositely opposed curved sections that serve to retain said biasing means within said bore and that serve to define corresponding gaps between said first and second nut jaw extensions.

23. The handheld ear piercer of claim 21, wherein said biasing means is a spring.

24. The handheld ear piercer of claim 14, wherein said ejection means comprises:

a flexible tang; and a post, said post coupling said flexible tang to said slidable engagement means.

25. The handheld ear piercer of claim 24, where said flexible tang is flared upward to engage an underside of said earring cartridge so as to better catch and expel said earring cartridge once said tang moves past said earring cartridge.

26. The handheld ear piercer of claim 14, wherein said earring cartridge comprises:

cradle means for carrying an earring;

a frangible tab coupled to said cradle means; and cover means for engaging said cradle means and for holding said earring in place in said cradle means.

27. A handheld ear piercer, comprising:

an earring jaw, said earring jaw defining first and second channels;

an earring cartridge, said earring cartridge slidably disposed in said first channel;

a nut jaw, said nut jaw slidably engaging said second channel;

a first runner, said first runner running along an interior length of said earring jaw approximately midway between a top side and a bottom side of said earring jaw adjacent a first side of the handheld ear piercer;

a second runner, said second runner running along the interior length of said earring jaw approximately midway between said top side and said bottom side of said earring jaw adjacent a second side of the handheld ear piercer opposite to said first side, said second runner oppositely opposed to said first runner, said first and second runners defining a communicating gap between said first and second channels;

a first stop, said first stop adjacent to said first runner and a first side of said earring jaw, said first stop approximately midway between a rear and a front of said earring jaw;

a second stop, said second stop adjacent to said second runner and a second side of said earring jaw, said second stop approximately midway between said rear and said front of said earring jaw;

a third stop, said third stop adjacent to said first side of said earring jaw and said top side of said earring jaw, said third stop approximately midway between said rear and said front of said earring jaw; and a fourth stop, said fourth stop adjacent to said second side of said earring jaw and said top side of said earring jaw, said fourth stop approximately midway between said rear and said front of said earring jaw;

said stops running a length from said rear of said earring jaw to approximately midway between said rear and said front of said earring jaw, whereby said earring cartridge is obstructed from further travel into said first channel by said stops;

a back end of said earring cartridge together with said rear of said earring jaw and said first and second sides serving to define a chamber behind said earring cartridge when said earring cartridge is obstructed from further travel into said first channel by said stops, said chamber providing room for a flexible tang to engage and eject said earring cartridge;

a first lateral projection extending inwardly from said first side of said earring jaw toward said second side; and a second lateral projection extending inwardly from said second side of said earring jaw toward said first side; whereby, said first and second lateral projections define a top gap between themselves above said earring cartridge;

said top gap extending into said earring jaw a distance just forward of said stops;

said bottom side of said earring jaw adjacent said second channel and defining an opening between an interior and an exterior of said earring jaw, said opening parallel to a length of said bottom side and extending from said rear of said earring jaw to a point just past a midpoint between said rear and said front of said earring jaw, said opening accommodating a hook coupled to said nut jaw introduced into said opening whereby said hook may travel along said opening and may be caught at a forward end thereof at said point just past said midpoint;

a spring post, said spring post coupled centrally to an interior rear wall of said second channel, said spring post extending into said second channel generally parallel to a bottom side approximately one-quarter the distance between said rear and said front of said earring jaw;

a first plurality of ribs, said first plurality of ribs present on the exterior of said earring jaw, generally opposite said second channel and oppositely opposed said spring post, said first plurality of ribs providing means by which secure manual engagement may be made of the exterior of said earring jaw;

said nut jaw comprising an elongated portion slidably engaging the interior of said second channel, said elongated portion having first and second nut jaw extensions defining a bore therebetween, said first nut jaw extension extending above said bore and said second nut jaw extension, said first and second nut jaw extensions having oppositely opposed curved sections that serve to retain a spring within said bore and that serve to define corresponding gaps between said first and second nut jaw extensions a flexible tang, said flexible tang flared upward to engage an underside of said earring cartridge so as to better catch and expel said earring cartridge once said tang moves past said earring cartridge;

a post, said post coupling said flexible tang to said elongated portion a neck portion, said neck portion coupled to said elongated portion and having a width slightly smaller than a width of said second channel so that said neck portion may slide easily within said second channel;

a tongue portion, said tongue portion extending from said neck portion and terminating in said hook, said tongue portion descending at an angle from said neck portion and into said opening defined by said bottom side whereby said hook may engage said forward end of said opening present in said bottom side of said earring jaw;

a base portion coupled to said neck portion, said base portion having a width approximately the same as a width of said earring jaw to provide means by which said nut jaw may be engaged by said earring jaw thereby obstructing further slidable travel of said nut jaw into said earring jaw;

an upright portion coupled to said base portion whereby a void is created by said upright portion between said upright portion, said neck portion and said earring jaw to provide room for an earlobe, said upright portion having a width approximately the same as a width of said earring jaw to provide means by which said nut jaw may be better engaged manually;

a second plurality of ribs, said second plurality of ribs present on an outward facing portion of said upright portion opposite said void with respect to said upright portion, said second plurality of ribs providing means by which secure manual engagement may be made of the exterior of said nut jaw;

a nut holding block, said upright portion supporting said nut holding block away from said neck portion, said nut holding block defining first and second nut grooves within which an earring nut may fit facing said earring jaw oppositely opposed to said earring cartridge, said first nut groove perpendicular to said second nut groove;

a finger, said finger rising up from a floor of said block in said first groove, said finger capable of engaging with slight friction a nut fitted in said first and second nut grooves whereby said nut may be securely held in place by said finger in said first and second grooves of said nut holding block yet easily disengaged from said block.

* * * * *